US011633030B1

(12) United States Patent
Lin

(10) Patent No.: US 11,633,030 B1
(45) Date of Patent: Apr. 25, 2023

(54) APPLICATOR

(71) Applicant: LIBO COSMETICS CO., LTD., Taichung (TW)

(72) Inventor: Hsiao-Yun Lin, Taichung (TW)

(73) Assignee: LIBO COSMETICS CO., LTD., Taichung (TW)

( * ) Notice: Subject to any disclaimer, the term of this patent is extended or adjusted under 35 U.S.C. 154(b) by 0 days.

(21) Appl. No.: 17/579,538

(22) Filed: Jan. 19, 2022

(51) Int. Cl.
*A45D 34/04* (2006.01)
*A45D 40/26* (2006.01)

(52) U.S. Cl.
CPC ..... *A45D 34/045* (2013.01); *A45D 40/265* (2013.01); *A45D 2200/10* (2013.01)

(58) Field of Classification Search
CPC ..... A46B 34/04; A46B 34/042; A46B 34/043; A46B 34/045; A46B 34/046; A46B 40/26; A46B 40/462; A46B 40/264; A46B 40/265; A46B 40/267; A46B 2200/10
USPC ..... 401/126–130, 261, 265, 266
See application file for complete search history.

(56) References Cited

U.S. PATENT DOCUMENTS

| | | | | |
|---|---|---|---|---|
| 3,906,625 | A * | 9/1975 | Gringer | B26B 5/005 30/331 |
| 4,398,839 | A * | 8/1983 | Kluck | B05C 17/12 15/245 |
| 5,658,384 | A * | 8/1997 | Imlay, Jr. | B05C 17/00 118/200 |
| 5,906,049 | A * | 5/1999 | Butts | B26B 5/001 30/125 |
| 6,375,377 | B1 * | 4/2002 | Lowery | B05C 17/10 401/265 |
| 11,064,798 | B2 | 7/2021 | Sanchez | |

* cited by examiner

*Primary Examiner* — David J Walczak
(74) *Attorney, Agent, or Firm* — Bruce Stone LLP; Joseph A. Bruce

(57) ABSTRACT

An applicator includes a blade, a holder and at least one fastener. The blade includes an exposed portion for contact with human skin and a concealed portion formed in one piece with the exposed portion. The holder receives the concealed portion of the blade. The fastener connects the concealed portion of the blade to the holder.

8 Claims, 16 Drawing Sheets

APPLICATOR

BACKGROUND OF INVENTION

1. Field of Invention

The present invention relates to an applicator and, more particularly, to an applicator for application of cosmetics, skin-care products, or topical medication on human skin.

2. Related Prior Art

U.S. Pat. No. 11,064,798 discloses an applicator member 8 operable for application of cosmetics on human skin. The applicator member 8 includes two portions 8a and 8b pivotally connected to each other by a hinge 34. The portion 8a of the applicator member 8 includes a hollow part 15. The portion 8b of the applicator member 8 includes a solid part 17. In use, the solid part 17 is fitted in the hollow part 15 to provide an applicator head 9.

The present invention is therefore intended to obviate or at least alleviate the problems encountered in prior art.

SUMMARY OF INVENTION

It is the primary objective of the present invention to provide an inexpensive and robust applicator.

To achieve the foregoing objective, the applicator includes a blade, a holder and at least one fastener. The blade includes an exposed portion for contact with human skin and a concealed portion formed in one piece with the exposed portion. The holder receives the concealed portion of the blade. The fastener connects the concealed portion of the blade to the holder.

In another aspect, the concealed portion of the blade includes at least one aperture for receiving the fastener.

In another aspect, the holder includes two halves connected to each other to provide a space for receiving the concealed portion of the blade.

In another aspect, one of the halves of the holder includes a sleeve inserted in the aperture of the concealed portion of the blade. The remaining one of the halves of the holder includes a stem inserted in the sleeve so that the sleeve and the stem together form the fastener.

In another aspect, the holder includes a hinge formed between the halves.

In another aspect, each of the halves of the holder includes a longitudinal portion formed on an internal face. The hinge is formed between the longitudinal portions of the halves of the holder.

In another aspect, each of the halves of the holder includes a transverse portion formed in one piece with the longitudinal portion. The transverse portions of the halves are located against each other when the halves are interconnected.

In another aspect, the transverse portion of one of the halves of the holder includes a bore. The transverse portion of the remaining one of the halves of the holder includes a boss fitted in the bore to connect the transverse portions of the halves of the holder to each other.

In another aspect, each of the halves of the holder includes an arched portion formed between the longitudinal and transverse portions. The blade includes a recess for receiving the arched portions of the halves of the holder.

In another aspect, each of the halves of the holder includes a semi-tube extending from the transverse portion so that the semi-tubes together form a tube as the halves of the holder are interconnected. The blade includes a shank inserted in the tube as the concealed portion of the blade is inserted in the holder.

Other objectives, advantages and features of the present invention will be apparent from the leading description referring to the attached drawings.

BRIEF DESCRIPTION OF DRAWINGS

The present invention will be described via detailed illustration of eleven embodiments referring to the drawings wherein.

DETAILED DESCRIPTION OF EMBODIMENTS

Figure 1:
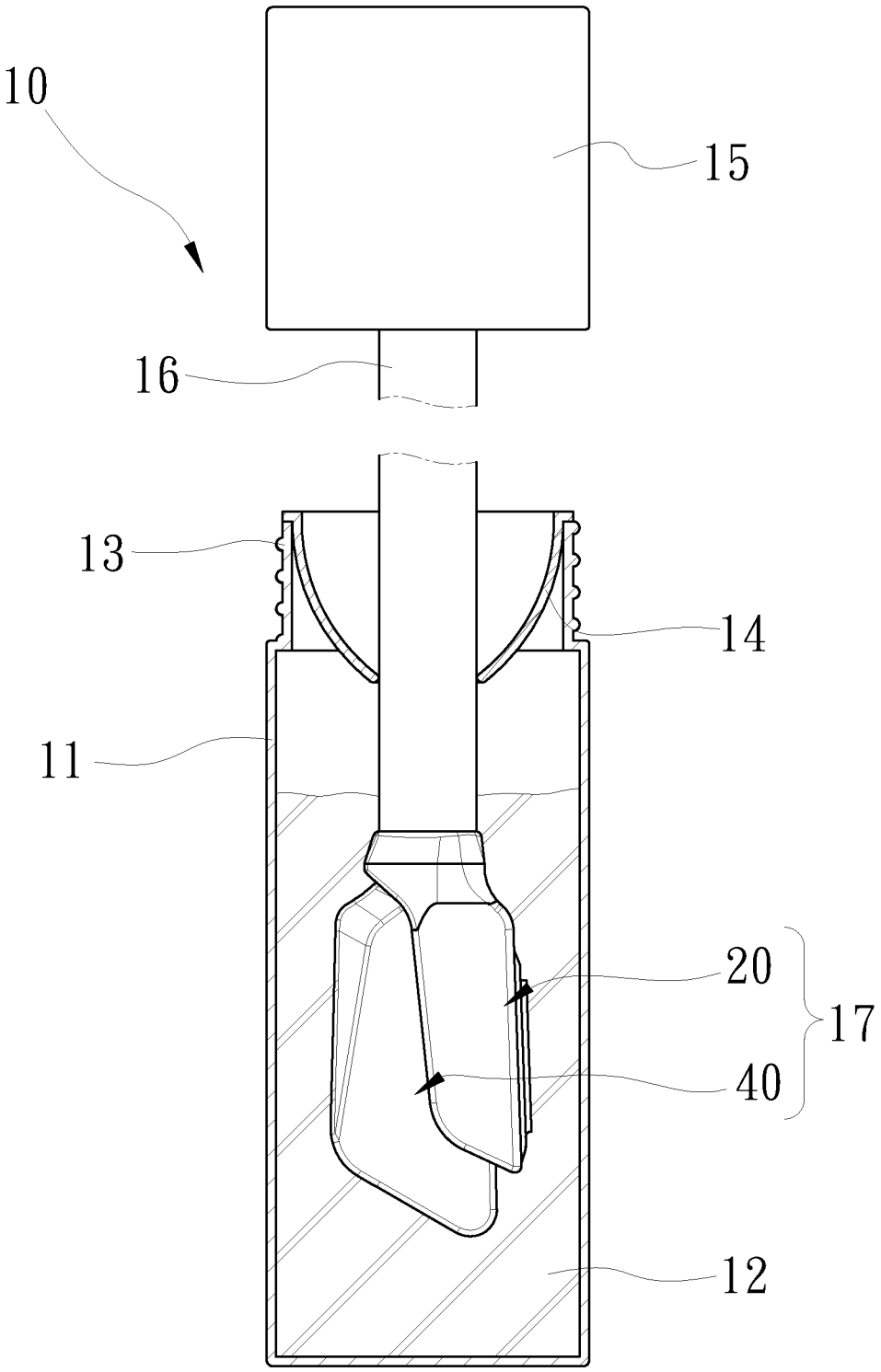
FIG. 1 is a side view of an applicator according to the first embodiment of the present invention inserted in a container.

Referring to FIG. 1, a storage and application apparatus 10 includes a container 11, a scraper 14, a cover/grip 15, a handle 16 and an applicator 17 according to a first embodiment of the present invention. For example, the container 11 is a bottle or a jar including a closed flat bottom and a neck 13. The container 11 includes a mouth at an upper end of the neck 13. The scraper 14 is an annular element connected to the neck 13 or inserted in the mouth of the container 11. A product 12 is filled in the container 11 through the neck 13 in production. The product 12 is poured from the container 11 via the neck 13 in use.

The product 12 is a cosmetic product, a skin-care product, or topical medication. Such a cosmetic product is a lipstick, lip gloss, concealer, eye shadow, primer (or "foundation"), highlighter (or "glow"), shading powder, eyebrow powder, eyebrow cream, or mascara. Such a skin-care product is essence, emulsion, cream, eye cream, repair cream, exfoliating cream, or remover. Such topical medication is anesthetic, antipruritic, analgesic, cold compress, hot compress, mint oil, or depilatory.

The cover/grip 15 is used to cover the mouth of the neck 13 of the container 11 to keep the product 12 in the container 11 or prevent the product 12 from curing or vaporization. The handle 16 includes an end connected to the cover/grip 15 and an opposite end connected to the applicator 17. Thus, a user is allowed to operate the cover/grip 15 to maneuver applicator 17 via the handle 16.

The applicator 17 is inserted deep in the container 11 via the scraper 14 when the cover/grip 15 is engaged with the neck 13. The scraper 14 scrapes contaminants from the handle 16, thereby keeping such contaminants out of the container 11.

The scraper 14 scrapes an excessive portion of the product 12 from the applicator 17 when the cover/grip 15 is detached from the neck 13. Thus, a proper portion of the product 12 is moved from the container 11 every time when the applicator 17 is moved from the container 11.

Referring to FIGS. 2 through 6, the applicator 17 includes a holder 20 and a blade 40. The blade 40 is used for contact with human skin while the holder 20 is used to hold the blade 40 in position. Hence, the blade 40 is made of a flexible material while the holder 20 is made of a rigid material, i.e., they are made in two pieces of different materials.

Figure 4:
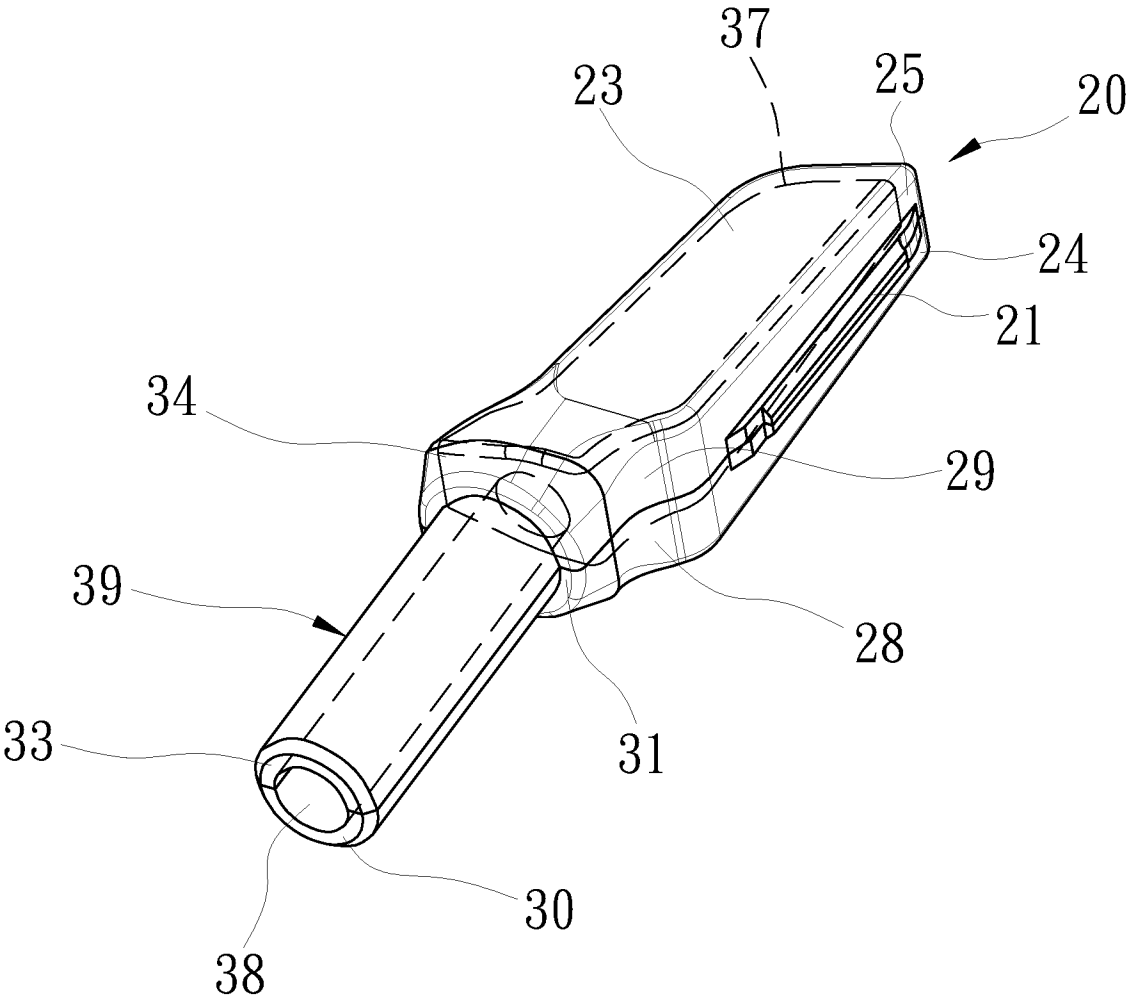
FIG. 4 is a perspective view of the applicator shown in FIG. 2 in a second position.

Referring to FIG. 4, the holder 20 includes a space 37 in an upper portion, a tube 39 at a lower portion, and two fasteners (not numbered) in the space 37. The tube 39 is axially formed with a tunnel 38 in communication with the space 37.

Figure 5:
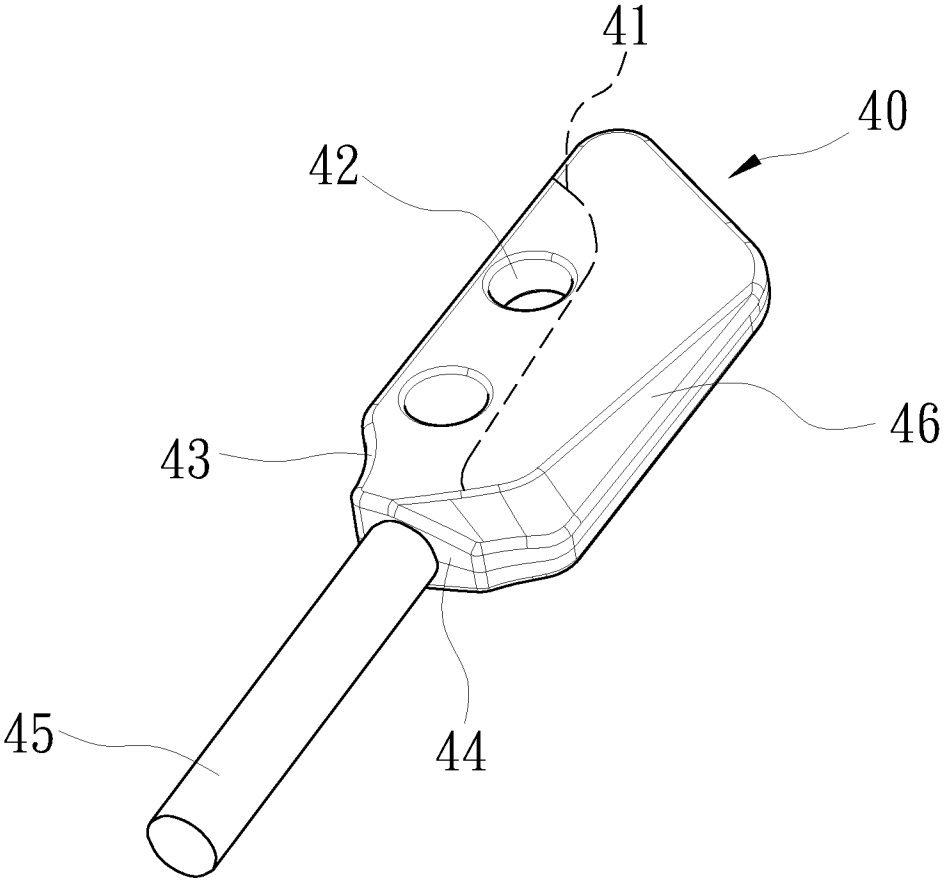
FIG. 5 is another perspective view of the applicator shown in FIG. 4.

Referring to FIG. 5, the blade 40 is formed with a concealed portion 41 and an exposed portion 46. The concealed portion 41 of the blade 40 is a rear edge of the blade 40. The concealed portion 41 of the blade 40 is formed with two apertures 42 and a recess 43. The exposed portion 46 of the blade 40 includes a front edge of the blade 40 and an upper edge of the blade 40. Preferably, there is a shank 45 extending from a lower edge 44 of the blade 40. The shank 45 is located near the recess 43.

Figure 2:
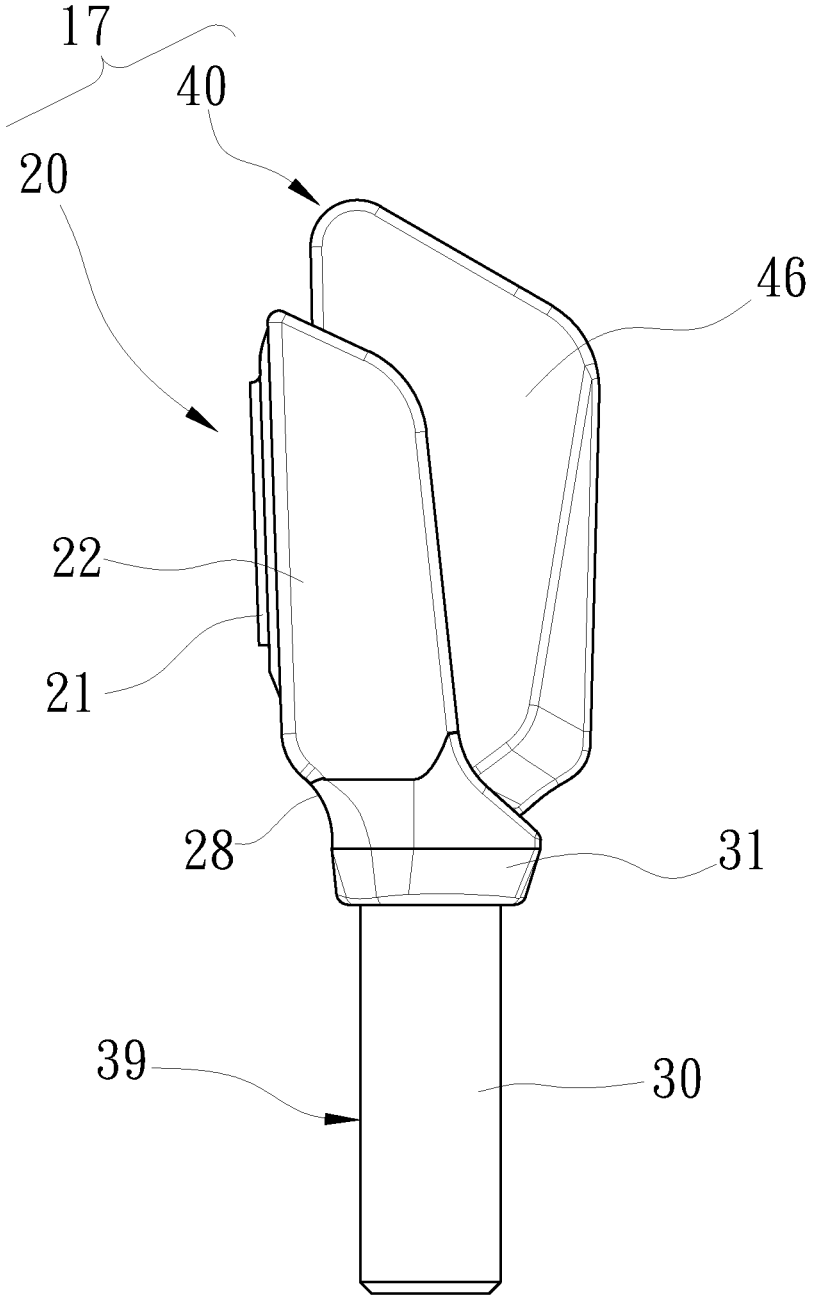
FIG. 2 is a partial view of the applicator shown in FIG. 1.
Figure 6:
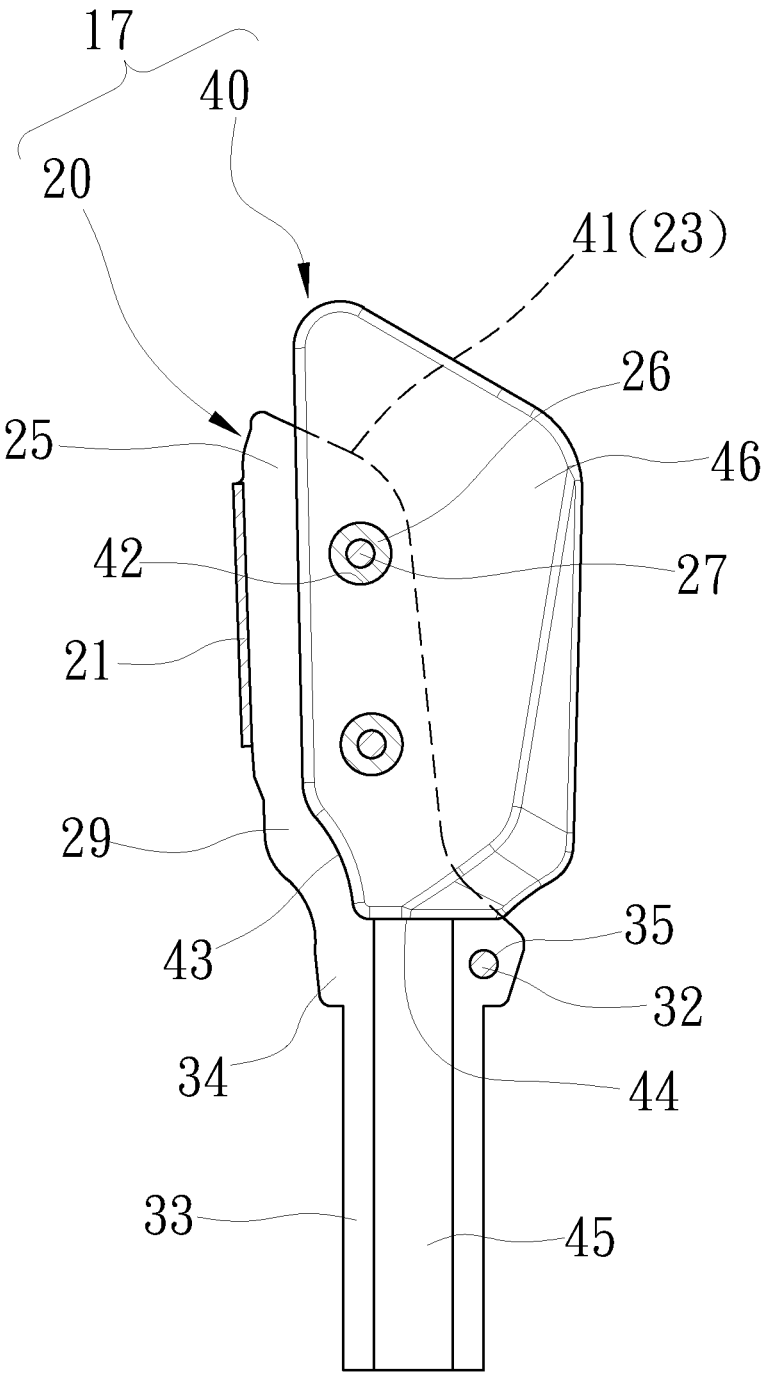
FIG. 6 is a cut-away view of the applicator shown in FIG. 2.

Referring to FIGS. 2 and 6, in assembly, the space 37 of the holder 20 receives the concealed portion 41 of the blade 40. The tube 39 receives the shank 45. The fasteners of the holder 20 are inserted in the apertures 42 of the blade 40 to keep the concealed portion 41 of the blade 40 in the space 37 of the holder 20. The exposed portion 46 of the blade 40 is located out of the space 37 of the holder 20. The exposed portion 46 of the blade 40 is used to apply a portion of the product 12.

Figure 3:
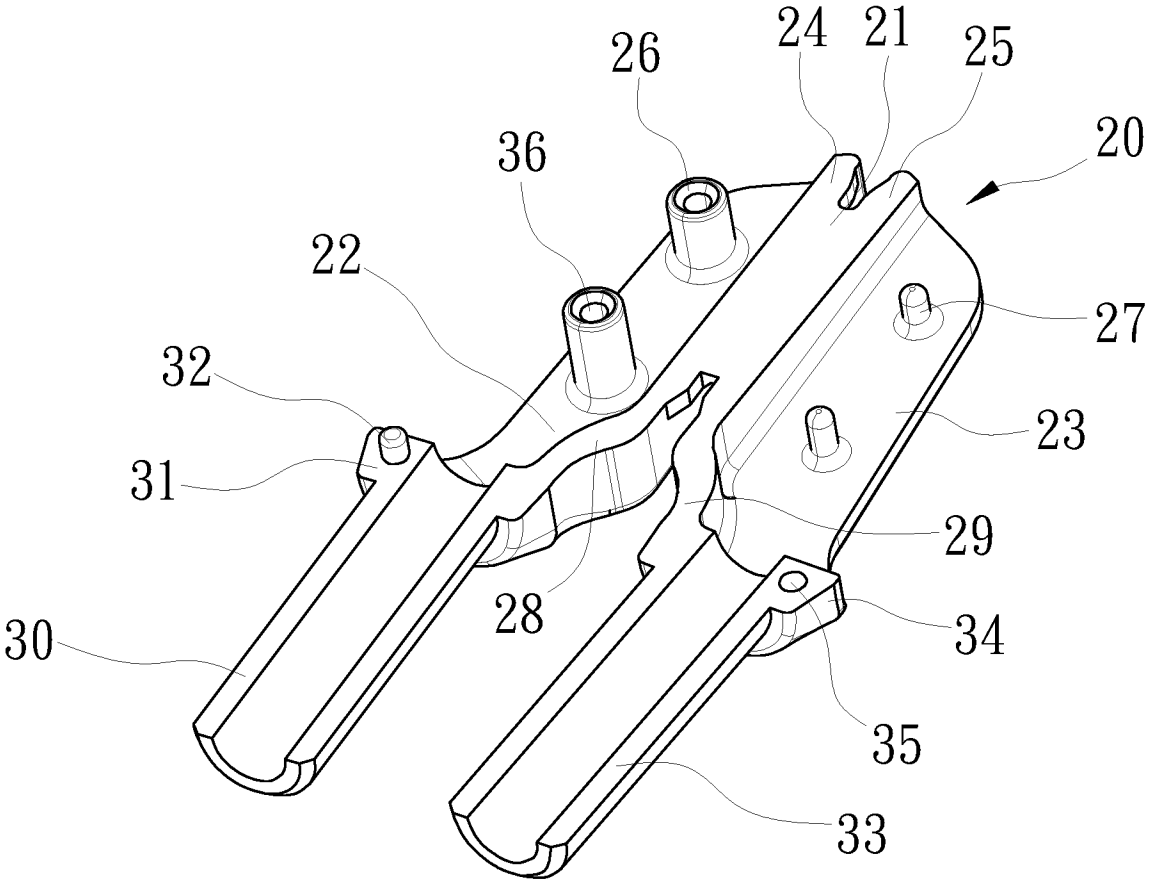
FIG. 3 is a perspective view of the applicator shown in FIG. 2 in a first position.

Referring to FIGS. 3 and 4, the holder 20 consists of two halves 22 and 23 connected to each other. Preferably, there is a hinge 21 formed between the halves 22 and 23. Thus, the hinge 21 and the halves 22 and 23 are made in one piece by molding of a proper plastic material. The holder 20 is in the position shown in FIG. 3 when it is molded. The holder 20 is in the position shown in FIG. 4 when it is assembled in a manner to be described. The hinge 21 allows the holder 20 to be moved to the position shown in FIG. 4 from the position shown in FIG. 3. However, the hinge 21 can be omitted in another embodiment.

The half 22 includes an L-shaped portion (not numbered) formed on an internal face of a flat portion (not numbered). The L-shaped portion of the half 22 includes an arched portion 28 formed between a longitudinal portion 24 and a transverse portion 31. The arched portion 28 is convex towards the space 37 of the holder 20. A semi-tube 30 extends from the transverse portion 31. A boss 32 is formed on an internal face of the transverse portion 31. Two sleeves 26 extend from an internal face of the flat portion of the half 22. Each of the sleeves 26 includes a cavity 36.

Similarly, the half 23 includes an L-shaped portion (not numbered) formed on an internal face of a flat portion (not numbered). The L-shaped portion of the half 23 includes an arched portion 29 formed between a longitudinal portion 25 and a transverse portion 34. The arched portion 29 is convex towards the space 37 of the holder 20. A semi-tube 33 extends from the transverse portion 34. A bore 35 is made in an internal face of the transverse portion 34. Two stems 27 extend from an internal face of the flat portion of the half 23. Each of the sleeves 26 includes a cavity 36.

In assembly, the stems 27 of the half 23 of the holder 20 are inserted in the sleeves 26 of the half 22 of the holder 20. Thus, each of the stems 27 and a corresponding one of the sleeves 26 together form one of the fasteners of the holder 20, which is inserted in a corresponding one of the apertures 42 of the blade 40. The boss 32 is fitted in the boss 35. The holder 20 is kept in the position shown in FIG. 4 since the stems 27 are fitted in the sleeves 26 and the boss 32 is fitted in the bore 35. The arched portions 28 and 29 of the halves 22 and 23 of the holder 20 are located side by side, in the recess 43 of the blade 40. The semi-tubes 30 and 33 are located side by side so that they together form the tube 39, which receives the shank 45.

As mentioned above, the exposed portion 46 of the blade 40 is located out of the holder 20. Hence, the exposed portion 46 of the blade 40 is operable to apply a portion of the product 12 on human skin.

Figure 7:
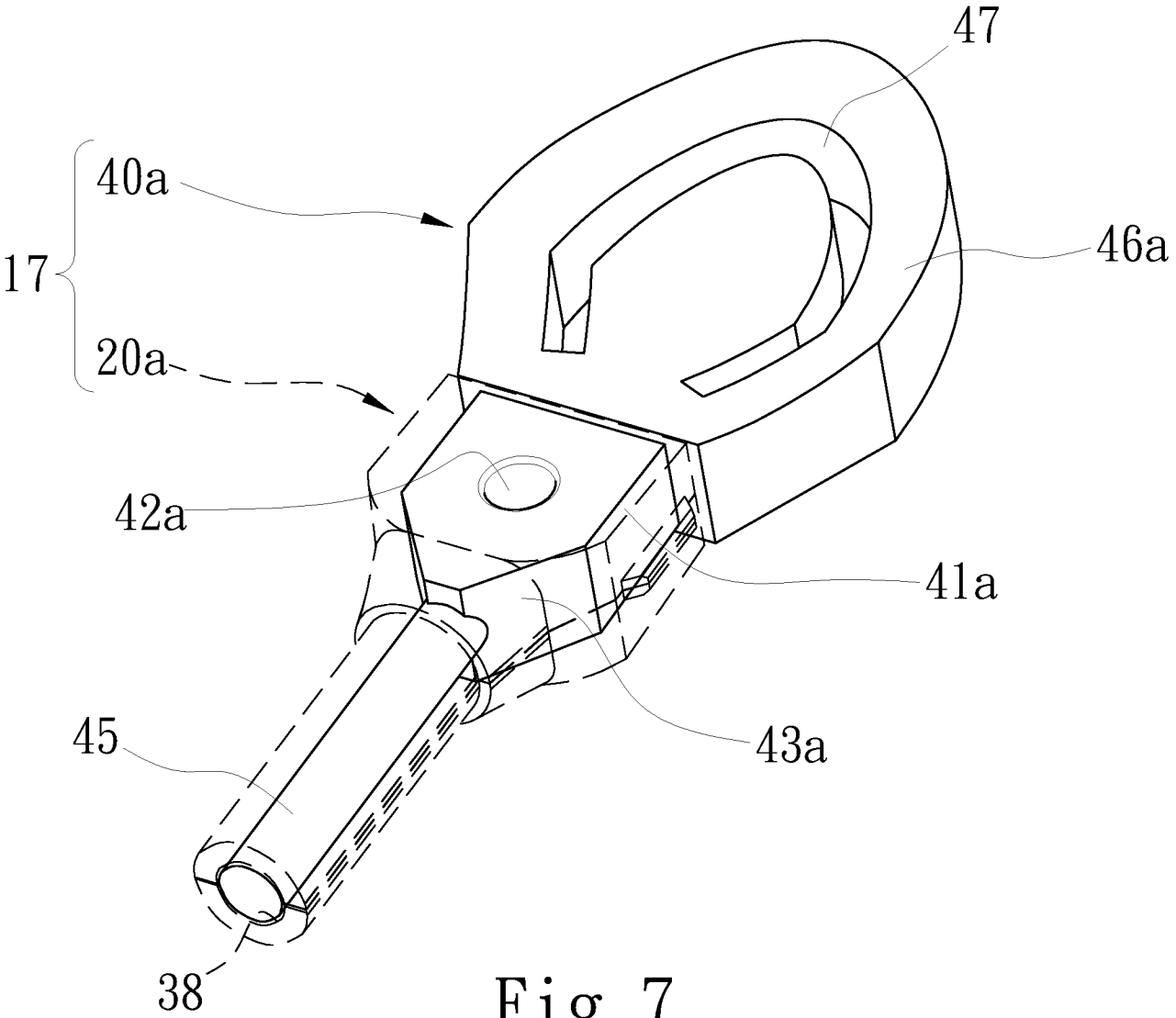
FIG. 7 is a partial side view of an applicator according to the second embodiment of the present invention.

Referring to FIG. 7, there is shown an applicator 17 according to a second embodiment of the present invention. The second embodiment is identical to the first embodiment except for including a holder 20*a* and a blade 40*a* instead of the holder 20 and the blade 40, respectively.

The blade 40*a* includes a concealed portion 41*a* and an exposed portion 46*a*. The concealed portion 41*a* is a lower portion of the blade 40*a*. The exposed portion 46*a* is an upper portion of the blade 40*a*. The exposed portion 46*a* of the blade 40*a* includes a slit 47 extending in an arched manner, thereby dividing the exposed portion of the blade 40*a* into a core and an arched peripheral portion extending around the core.

The concealed portion 41*a* of the blade 40*a* includes only one aperture 42*a*. Accordingly, the holder 20*a* includes one fastener inserted in the aperture 42*a*. As mentioned above, the fastener of the holder 20*a* consists of a sleeve 26 and a stem 27.

Figure 8:
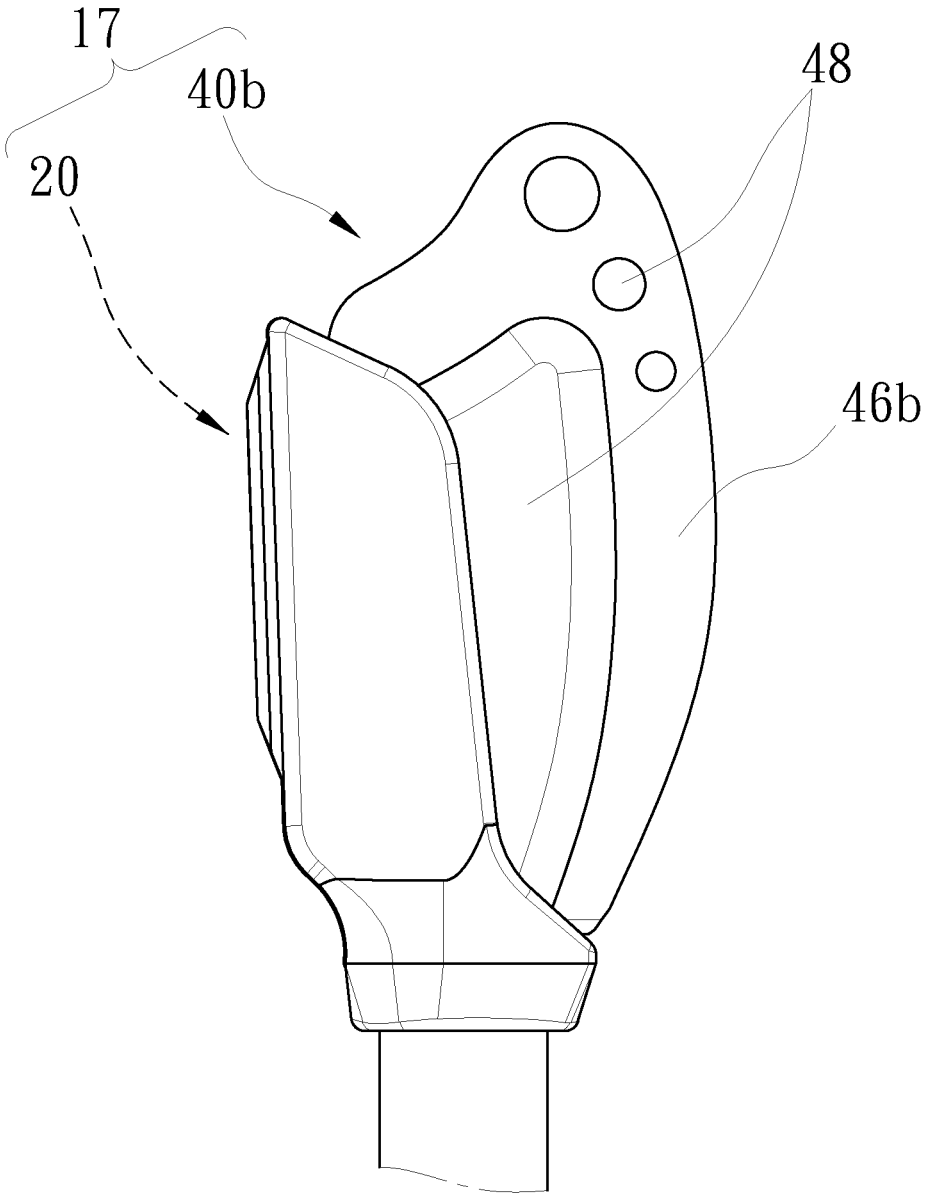
FIG. 8 is a partial side view of an applicator according to the third embodiment of the present invention.

Referring to FIG. 8, there is shown an applicator 17 according to a third embodiment of the present invention. The third embodiment is identical to the first embodiment except for including a blade 40*b* instead of the blade 40. The blade 40*b* is like the blade 40 except for two things. Firstly, the blade 40*b* includes an exposed portion 46*b* in the form of an axe. Secondly, the exposed portion 46*b* of the blade 40*b* includes patterns 48 in addition. The patterns 48 can be circular or in any other proper shapes.

Figure 9:
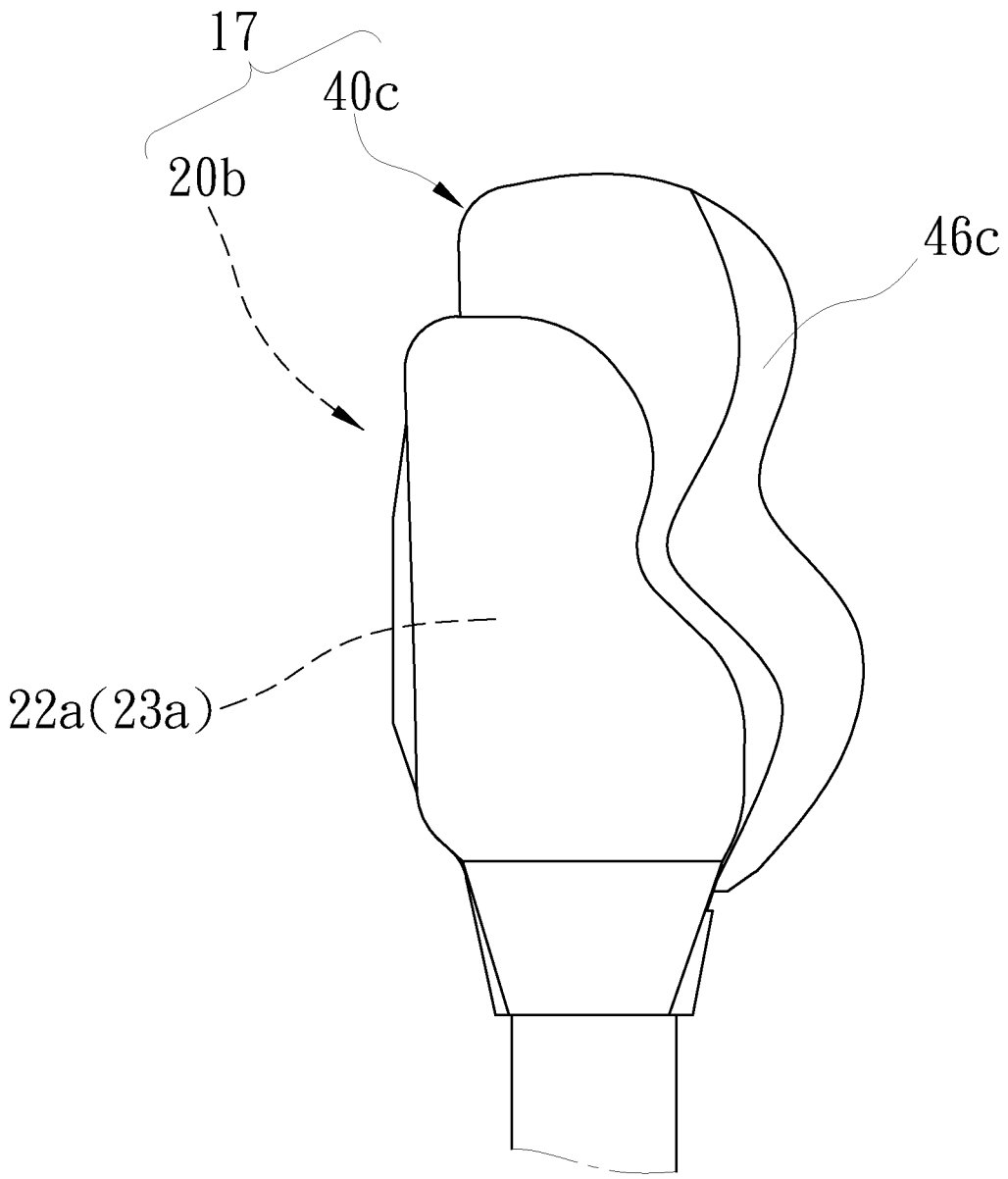
FIG. 9 is a partial side view of an applicator according to the fourth embodiment of the present invention.

Referring to FIG. 9, there is shown an applicator 17 according to a fourth embodiment of the present invention. The fourth embodiment is identical to the first embodiment except for including a holder 20*b* and a blade 40*c* instead of the holder 20 and the blade 40, respectively. The holder 20*b* is like the holder 20 except for including two halves 22*a* and 23*a* instead of the halves 22 and 23, respectively. The halves 22*a* and 23*a* are respectively identical to the halves 22 and 23 except for being in a different shape. The blade 40*c* is identical to the blade 40 except for including an exposed portion 46*c* instead of the exposed portion 46. The exposed portion 46*c* is identical to the exposed portion 46 except for being in a different shape.

Figure 10:
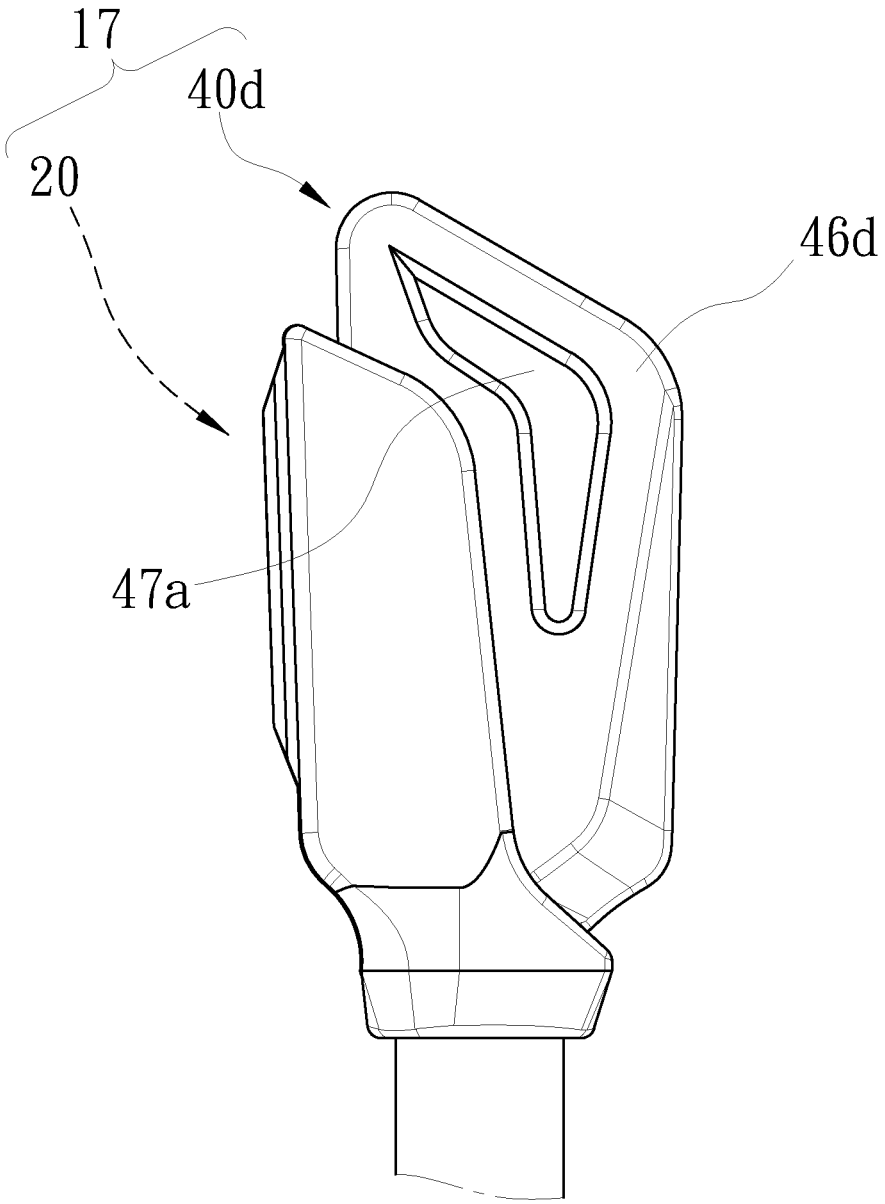
FIG. 10 is a partial side view of an applicator according to the fifth embodiment of the present invention.

Referring to FIG. 10, there is shown an applicator 17 according to a fifth embodiment of the present invention. The fifth embodiment is identical to the first embodiment except for including a blade 40*d* instead of the blade 40. The blade 40*d* includes an exposed portion 46*d* instead of the exposed portion 46. That exposed portion 46*d* is identical to the exposed portion 46 except for including a slit 47*a* in addition.

Figure 11:
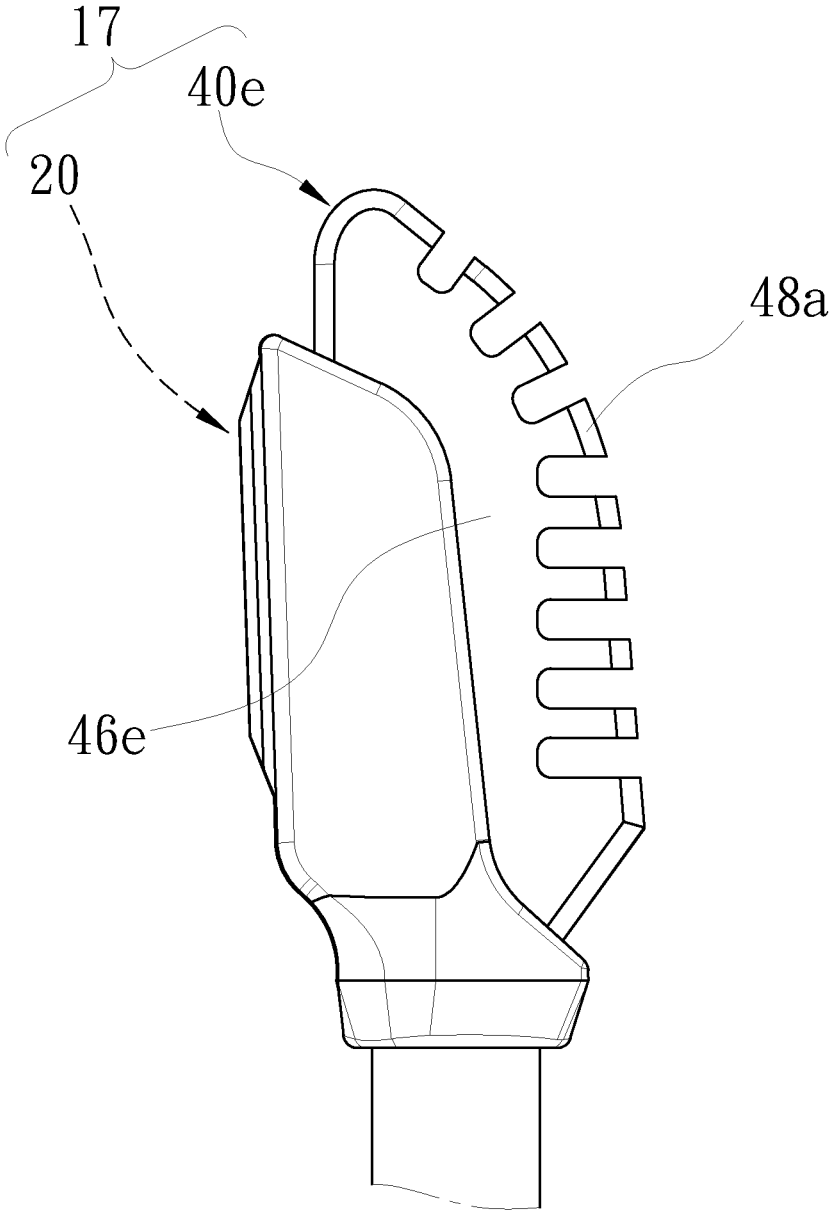
FIG. 11 is a partial side view of an applicator according to the sixth embodiment of the present invention.

Referring to FIG. 11 there is shown an applicator 17 according to a sixth embodiment of the present invention. The sixth embodiment is identical to the first embodiment except for including a blade 40*e* instead of the blade 40. The blade 40*e* is identical to the blade 40 except for including an exposed portion 46*e* instead of the exposed portion 46. The exposed portion 46*e* is identical to the exposed portion except for including teeth 48*a* separated from one another by gaps. Each of the teeth 48*a* is preferably provided with a trim.

Figure 12:
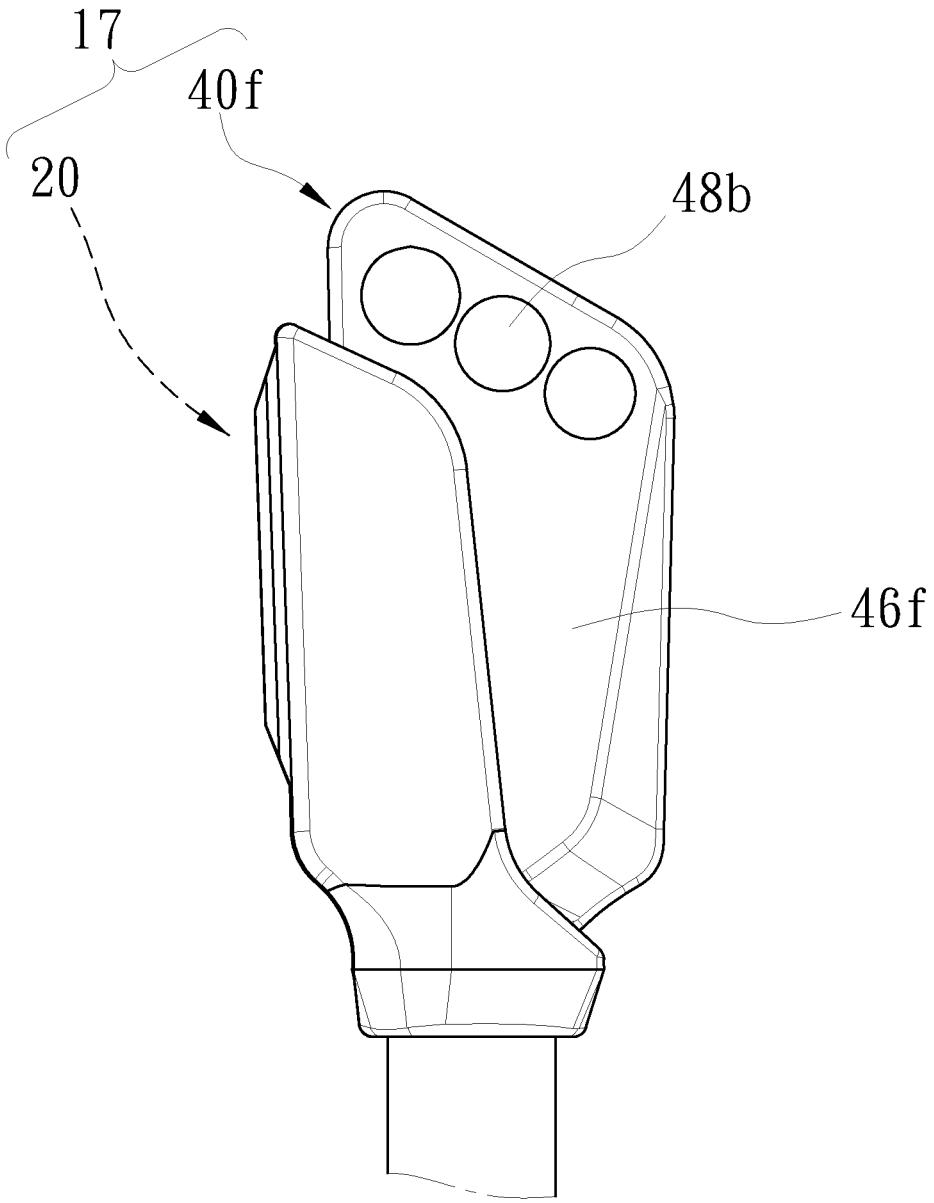
FIG. 12 is a partial side view of an applicator according to the seventh embodiment of the present invention.

Referring to FIG. 12, there is shown an applicator 17 according to a seventh embodiment of the present invention. The seventh embodiment is like the fifth embodiment except for including a blade 40*f* instead of the blade 40. The blade 40*f* is identical to the blade 40 except for including an exposed portion 46*f* instead of the exposed portion 46. The exposed portion 46*f* is identical to the exposed portion 46 except for including patterns 48*b* in addition. The patterns 48 can be circular or in any other proper shapes.

Figure 13:
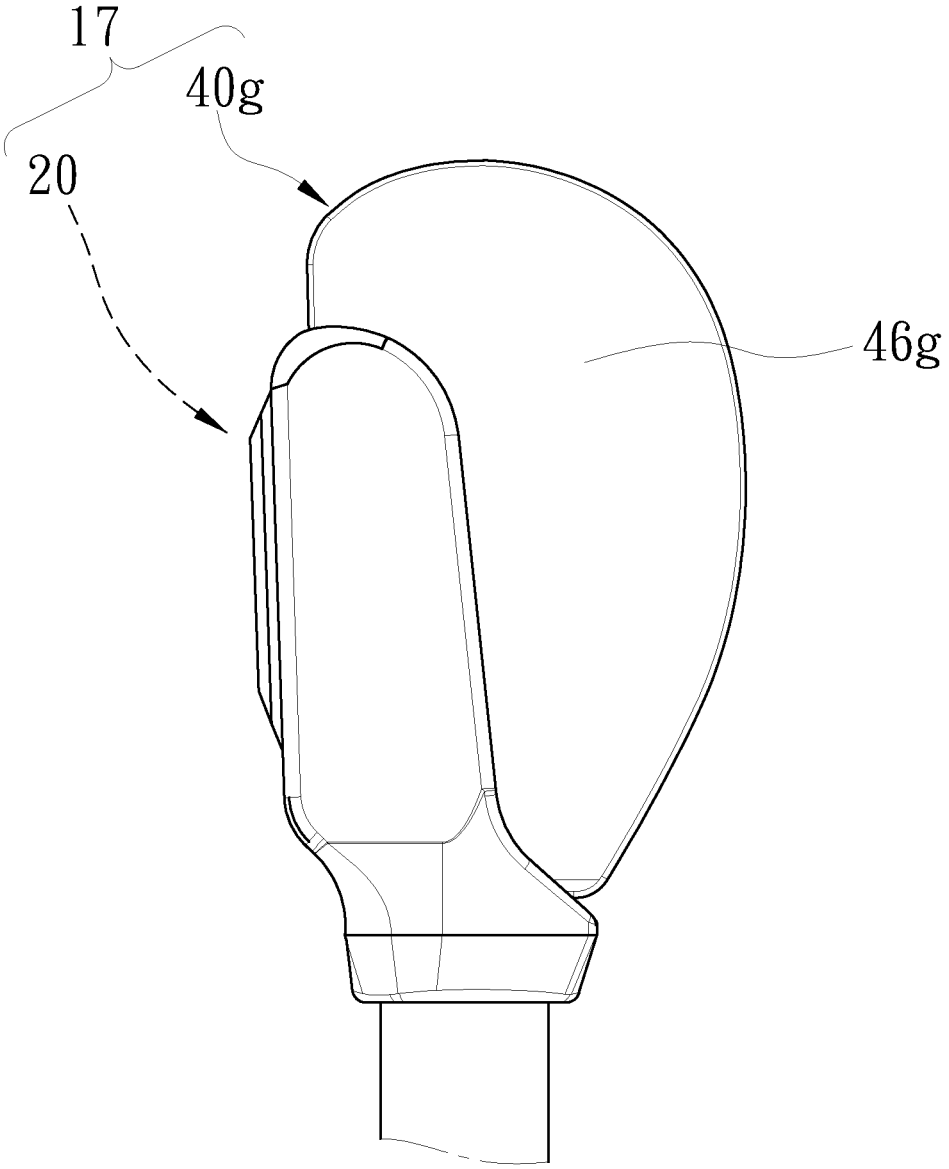
FIG. 13 is a partial side view of an applicator according to the eighth embodiment of the present invention.

Referring to FIG. 13, there is shown an applicator 17 according to an eighth embodiment of the present invention. The eighth embodiment is identical to the first embodiment except for including a blade 40*g* instead of the blade 40. The blade 40*g* is identical to the blade 40 except for including an arched exposed portion 46*g* instead of the arched exposed portion 46.

Figure 14:
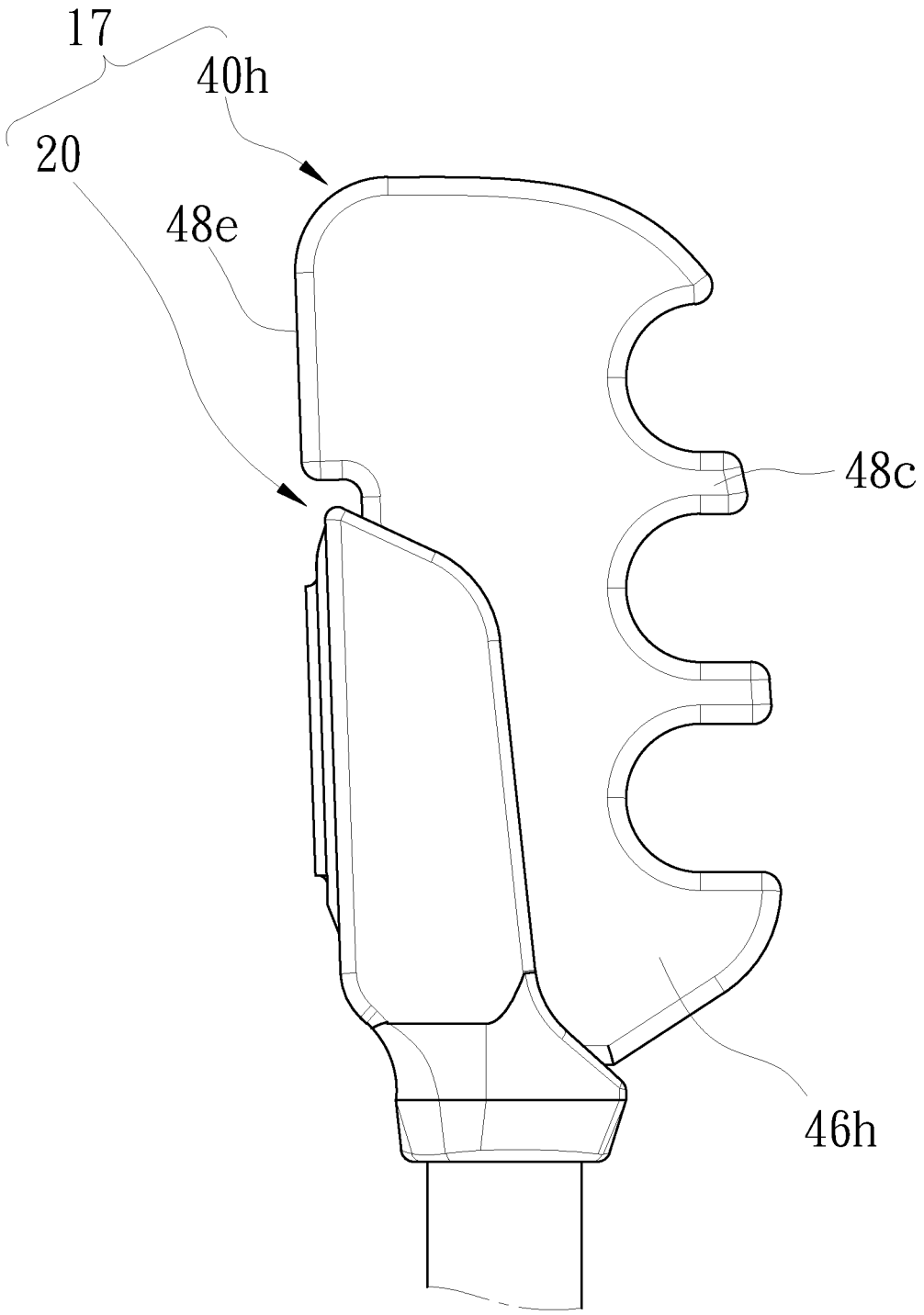
FIG. 14 is a partial side view of an applicator according to the ninth embodiment of the present invention.

Referring to FIG. 14, there is shown an applicator 17 according to a ninth embodiment of the present invention. The ninth embodiment is identical to the sixth embodiment except for including a blade 40*h* instead of the blade 40*e*. The blade 40*h* is identical to the blade 40*e* except for including an exposed portion 46*h* instead of the exposed portion 46*e*. The exposed portion 46*h* is identical to the exposed portion 46*e* except for two things. Firstly, the blade 40*h* includes teeth 48*c* instead of the teeth 48*a*. The teeth 48*c* are in different locations from the teeth 48*a*. The gap between two adjacent ones of the teeth 48*c* is larger than the gap between two adjacent ones of the teeth 48*a*. Secondly, the exposed portion 46*h* includes a protuberance 48*e* extending opposite to the teeth 48*c*.

Figure 15:
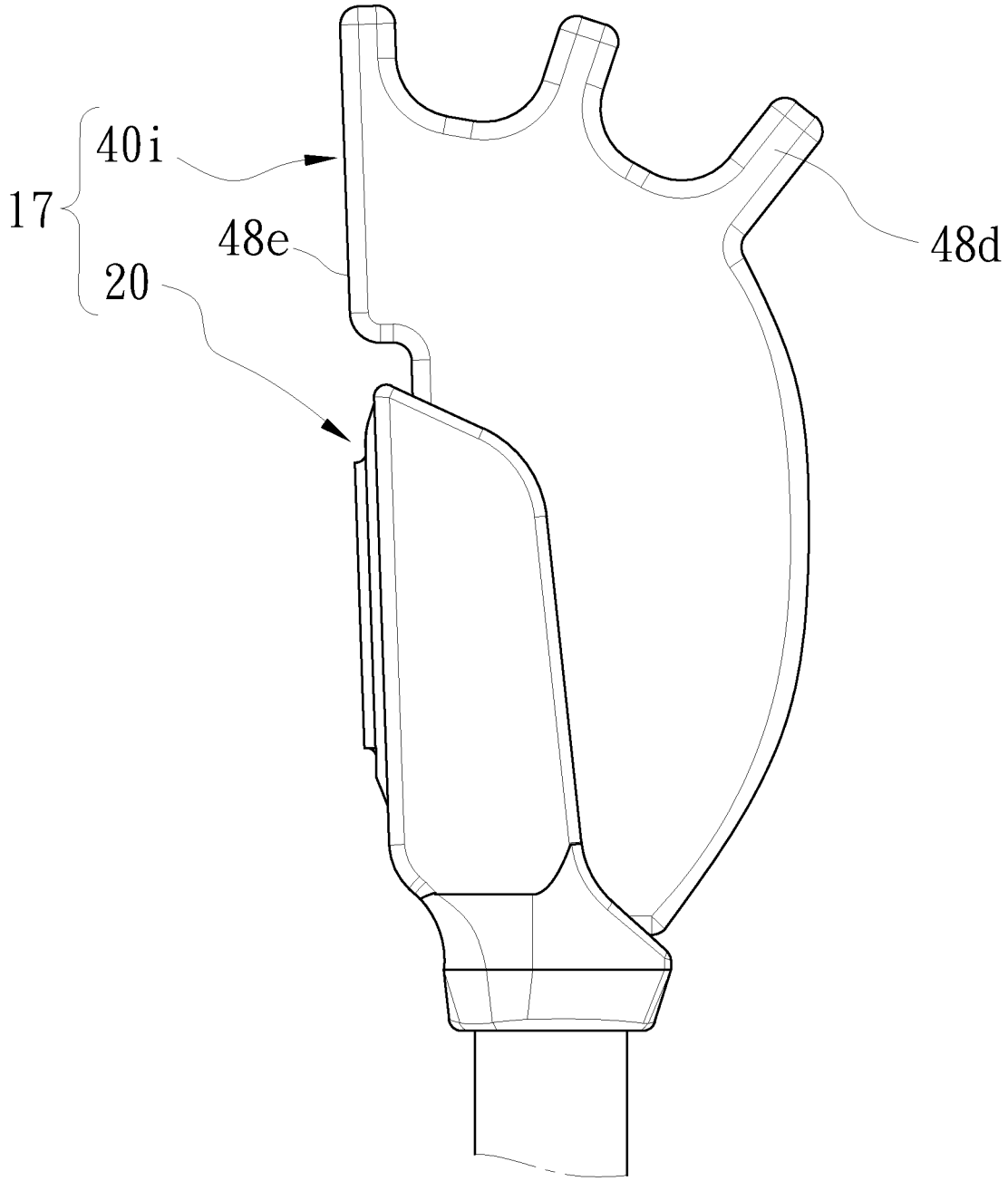
FIG. 15 is a partial side view of an applicator according to the tenth embodiment of the present invention.

Referring to FIG. 15, there is shown an applicator 17 according to a tenth embodiment of the present invention. The tenth embodiment is identical to the ninth embodiment except for including a blade 40*i* instead of the blade 40*h*. The blade 40*i* is identical to the blade 40*h* except for including teeth 48*d* instead of the teeth 48*c*. The teeth 48*d* are in different locations than the teeth 48*c*.

Figure 16:
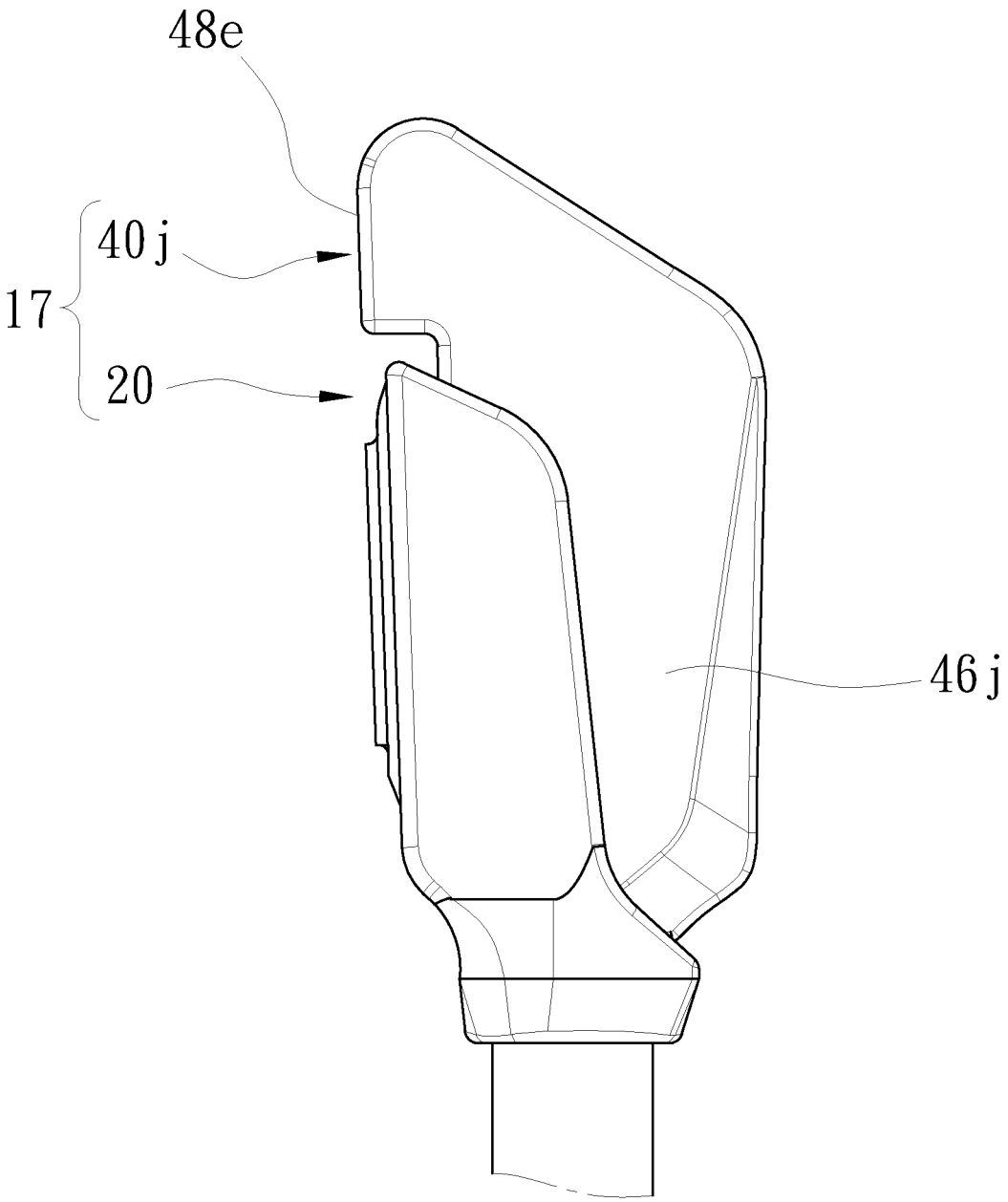
FIG. 16 is a partial side view of an applicator according to the eleventh embodiment of the present invention.

Referring to FIG. 16, there is shown an applicator 17 according to an eleventh embodiment of the present invention. The eleventh embodiment is like the first embodiment except for including a blade 40*j* instead of the blade 40. The blade 40*j* is identical to the blade 40 except for including an exposed portion 46*j* instead of the exposed portion 46. The exposed portion 46*j* is identical to the exposed portion 46 except for including a protuberance 48*e* extending backward, i.e., from a rear edge of the blade 40*j*.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. An applicator comprising:

a blade comprising an exposed portion for contact with human skin and a concealed portion formed in one piece with the exposed portion;

a holder comprising two halves connected to each other to provide a space for receiving the concealed portion of the blade, wherein each of the halves comprises a transverse portion, wherein the transverse portions are located against each other when the halves are interconnected, and wherein one of the transverse portions comprises a boss and the remaining one of the transverse portions comprises a bore for receiving the boss to keep the halves connected to each other; and at least one fastener for connecting the concealed portion of the blade to the holder.

2. The applicator according to claim 1, wherein the concealed portion of the blade comprises at least one aperture for receiving the fastener.

3. The applicator according to claim 1, wherein one of the halves of the holder comprises a sleeve, and the remaining one of the halves of the holder comprises a stem inserted in the sleeve so that the sleeve and the stem together form the fastener, and the concealed portion of the blade comprises at least one aperture for receiving the fastener.

4. The applicator according to claim 1, wherein the holder comprises a hinge formed between the halves of the holder.

5. The applicator according to claim 4, wherein each of the halves of the holder comprises a longitudinal portion formed on an internal face, wherein the hinge is formed between the longitudinal portions of the halves of the holder.

6. The applicator according to claim 5, wherein each of the halves of the holder comprises an arched portion formed between the longitudinal and transverse portions, wherein the blade comprises a recess for receiving the arched portions of the halves of the holder.

7. The applicator according to claim 1, wherein the holder comprises a tube, and the blade comprises a shank inserted in the tube.

8. An applicator comprising:

a blade comprising an exposed portion for contact with human skin, a concealed portion formed in one piece with the exposed portion, and a shank extending from the concealed portion;

a holder comprising two halves connected to each other to provide a space for receiving the concealed portion, wherein each of the halves of the holder comprises a semi-tube so that the semi-tubes together form a tube when the halves of the holder are interconnected, and wherein the shank is inserted in the tube when the concealed portion of the blade is inserted in the holder; and at least one fastener for connecting the concealed portion of the blade to the holder.

* * * * *